US005090876A

United States Patent [19]

Hashizume et al.

[11] Patent Number: 5,090,876

[45] Date of Patent: Feb. 25, 1992

[54] SCROLL TYPE FLUID HANDLING MACHINE

[75] Inventors: Naoki Hashizume, Saitama; Takeshi Seto, Nagano, both of Japan

[73] Assignee: Seiko Epson Corporation, Tokyo, Japan

[21] Appl. No.: 601,776

[22] PCT Filed: Feb. 23, 1990

[86] PCT No.: PCT/JP90/00225

§ 371 Date: Oct. 26, 1990

§ 102(e) Date: Oct. 26, 1990

[87] PCT Pub. No.: WO90/10157

PCT Pub. Date: Sep. 7, 1990

[30] Foreign Application Priority Data

Feb. 28, 1989 [JP] Japan ..... 1-45448

[51] Int. Cl.[5] ..... F04B 17/00; F04C 2/00; F04C 15/00

[52] U.S. Cl. ..... 417/410; 417/366; 418/55.3; 418/188

[58] Field of Search ..... 417/366, 410, 423.7; 418/55.3, 188

[56] References Cited

U.S. PATENT DOCUMENTS 4,178,143 12/1979 Thelan et al. ..... 418/188
4,795,323 1/1989 Lessie ..... 418/55.3
4,854,831 8/1989 Etemard et al. ..... 417/366

FOREIGN PATENT DOCUMENTS 60-159389 8/1985 Japan ..... 418/55.3
60-159390 8/1985 Japan ..... 418/55.3

*Primary Examiner*—Richard A. Bertsch
*Assistant Examiner*—Alfred Basichas
*Attorney, Agent, or Firm*—Kanesaka & Takeuchi

[57] ABSTRACT

Here is disclosed a full system rotatable scroll type fluid handling machine having a casing containing therein an electromotor, a driver scroll member and a follower scroll member, these two scroll members being rotatably driven by said electromotor to perform compression of refrigerant, wherein the casing is formed therein with a boss around which a shaft of a coupling is mounted so as to serve also as a rotational shaft of the electromotor for rotatably driving the driver scroll member and the boss supports a follower shaft of the follower scroll member. In this manner, several functions to which separate locations have conventionally assigned can be achieved on a single location, allowing an axial length of the machine to be reduced and thereby a compact machine to be obtained.

1 Claim, 2 Drawing Sheets

SCROLL TYPE FLUID HANDLING MACHINE

TECHNICAL FIELD

The present invention relates to a full system rotatable scroll type fluid handling machine comprising a sealed casing containing therein an electromotor, a driver scroll member adapted to be rotatably driven by said electromotor and a follower scroll member adapted to be eccentrically rotated with respect to said driver scroll member so that both the driver scroll member and the follower scroll member are rotated as said electromotor is energized but said follower scroll member presents an eccentric movement while it is rotated.

PRIOR ART

The full system rotatable scroll type fluid handling machine is well known, in which both the driver scroll member and the follower scroll member are rotated to achieve compression of refrigerant.

With such scroll type fluid handling machine of prior art, there has usually been provided the arrangement that the rotational center of the follower scroll member is made eccentric with respect to the rotational center of the driver scroll member and these two scroll members are engaged with each other. As said driver scroll member is rotatably driven by the drive source, said follower scroll member presents an eccentric movement while it is rotated and thus compression of refrigerant is successively carried out in the compression chambers defined by these two scroll members.

For rotatably driving the driver scroll member, Japanese Patent Application Disclosure Gazette No. 1975-32512 discloses the arrangement that a pulley is mounted on a drive shaft of the scroll member and the latter is rotatably driven by an electromotor via a belt operatively connecting said pulley with the electromotor, and Japanese Patent Application Disclosure Gazette No. 1987-210279 discloses the arrangement that a rotor is mounted on the drive shaft of the driver scroll member at a location remote from the driver scroll member itself with respect to a bearing bracket serving to support said drive shaft and a stator is disposed around said rotor so as to constitute an electromotor for rotatably driving the driver scroll member.

However, the arrangement utilizing a pulley/belt combination necessarily increases an axial dimension of the shaft because the drive shaft and the follower shaft are supported by separate bearings and the drive shaft carries the pulley for power transmission. The arrangement having the rotor mounted on the drive shaft also necessarily results in an increased axial dimension of the shaft because of the bearing bracket for the drive shaft mounted thereon between the driver scroll member and the electromotor. In this manner, both of the above-mentioned well known arrangements have prevented the scroll type fluid handling machine from being made compact due to their inherent features inevitably resulting in increased axial dimension of the respective scroll type fluid handling machines.

Accordingly, it is a primary object of the invention to provide a scroll type fluid handling machine so improved as to enable its axial length to be effectively reduced and thereby provide a compact machine.

SUMMARY OF THE INVENTION

The object set forth above is achieved, in accordance with the present invention, by a full system rotatable scroll type fluid handling machine comprising a sealed casing containing therein a cylindrical boss, a coupling carried around said boss to rotate a driver scroll member, an electromotor mounted on this location (i.e., around the boss), and a shaft (i.e., follower shaft) of a follower scroll member supported on the inner periphery of said boss. In this way, not only the scroll members which have conventionally been supported on separate locations can be supported on substantially the same location (i.e., inner and outer peripheries of the cylindrical boss) but also the electromotor can be mounted on the same location. As a result, it becomes possible to reduce the axial length of the machine and thereby to make the machine compact, even when the machine is of the full system rotatable type.

BRIEF DESCRIPTION OF THE DRAWINGS

FIGS. 1 and 2 illustrate an embodiment of the scroll type fluid handling machine constructed according to the present invention wherein FIG. 1 is a sectional view and FIG. 2 is an exploded perspective view.

PREFERRED EMBODIMENT

Details of the invention will be apparent from the following description made in reference with the accompanying drawings.

Figure 1:
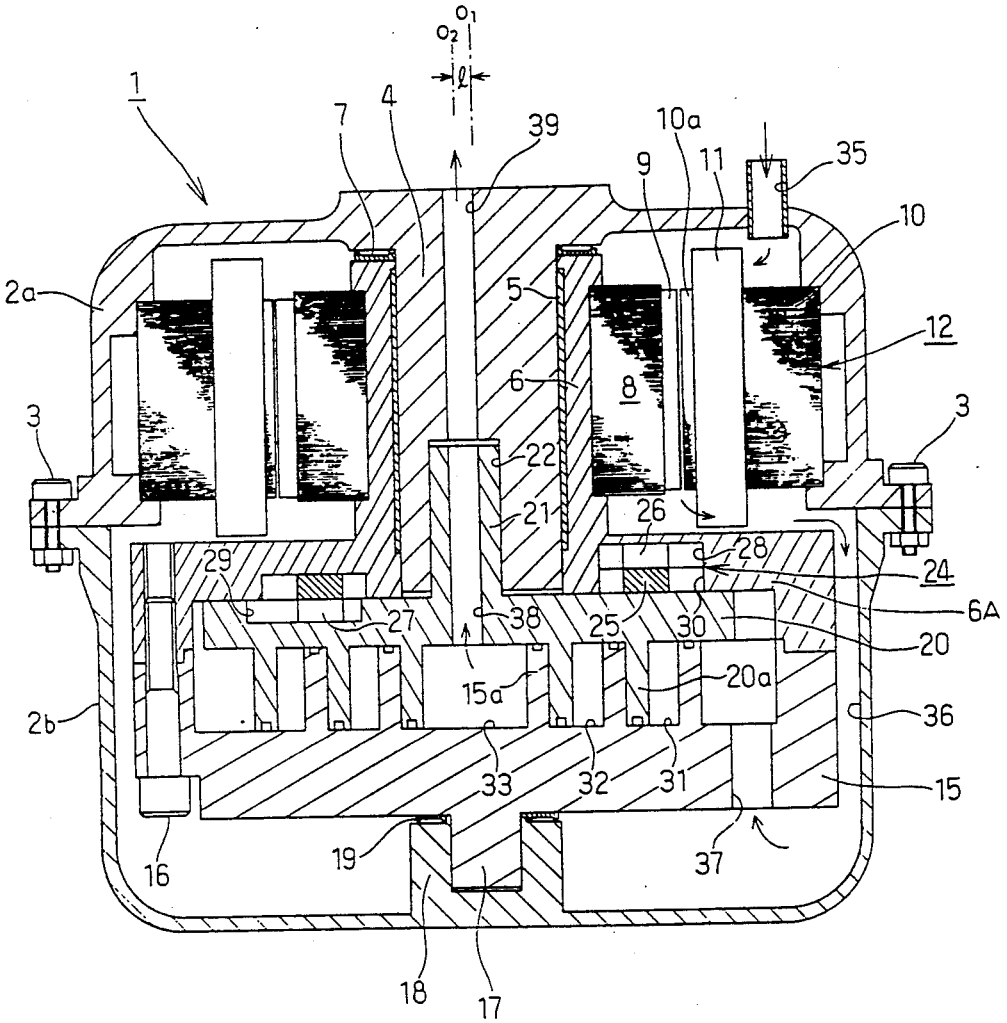
Figure 2:
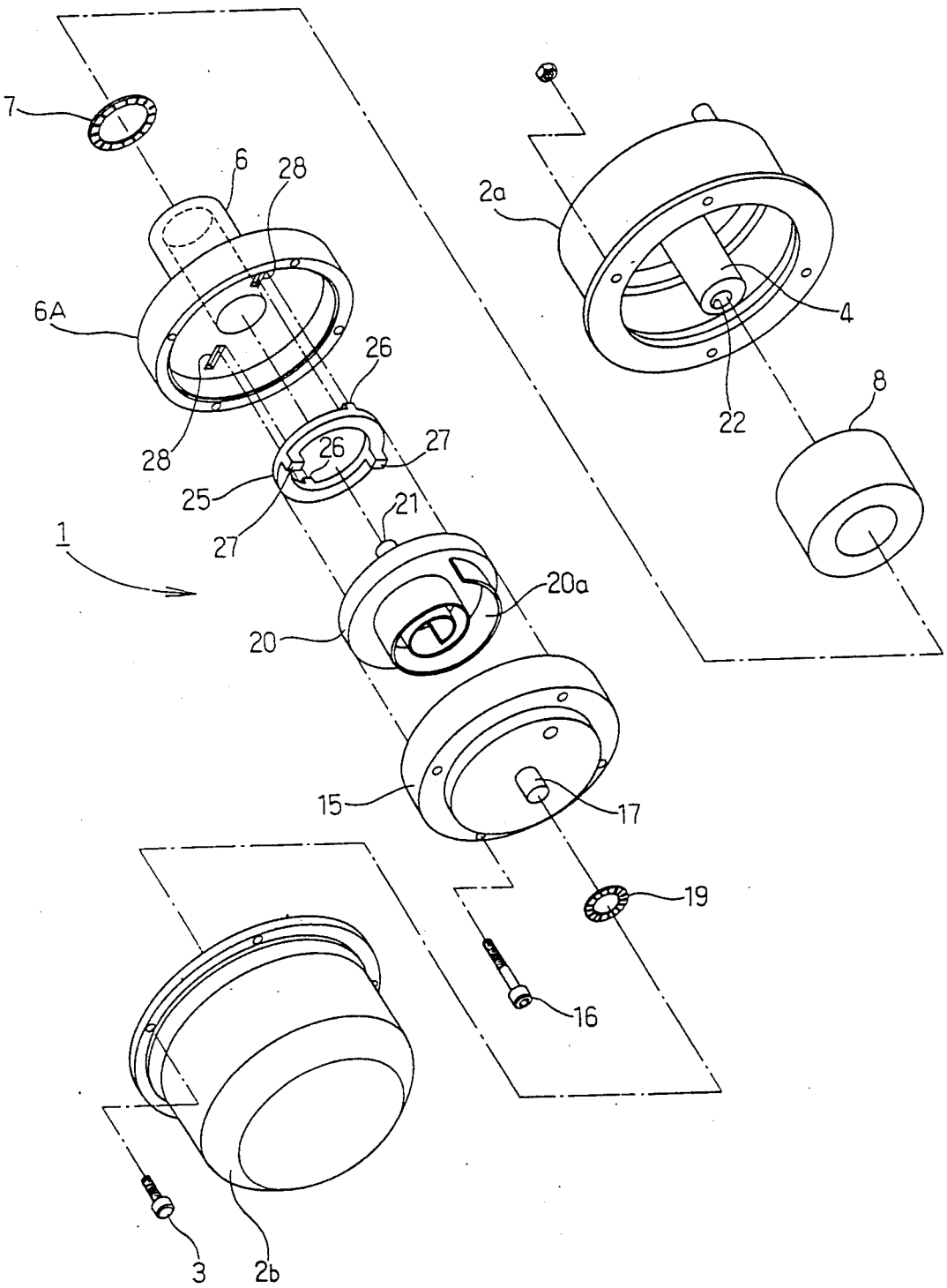

FIG. 1 is an axial sectional view of a scroll type fluid handling machine (motor compressor of scroll type) constructed according to the invention and FIG. 2 is an exploded perspective view thereof, in which essential parts are somewhat exaggeratedly illustrated with respect to the remainder in order to facilitate understanding of the invention. Referring to FIGS. 1 and 2, numerals 2*a* and 2*b* designate an upper casing and a lower casing, respectively, and these casings 2*a*, 2*b* are secured together by bolts 3 so as to define a sealed interior.

The upper casing 2*a* is centrally provided on its inner side with a boss 4 integrally with the upper casing 2*a* and extending downward. The boss 4 extends in a direction coinciding with a rotational axis of scroll members which will be described later and a cylindrical shaft 6 of a coupling 6A is rotatably mounted around said boss 4 by means of a metallic bearing 5. There is provided a bearing 7 between a top end surface of said shaft 6 and the upper casing 2*a*.

A pillar-shaped rotor consisting of a laminated iron core is fixed around said shaft 6, and around said rotor 8 there are provided permanent magnets 9 so that N and S poles alternate with one another. A cylindrical stator 10 consisting of a laminated iron core is fixed to the upper casing 2*a* so as to surround the permanent magnets 9. Furthermore, there are provided excitation coils 11 wound around respective poles 10*a* of the stator 10 and these components constitute together an electromotor 12 by which the shaft 6 is rotated integrally with its rotor 8.

Said shaft 6 is provided at its lower end with an annular member covering a rear side of a follower scroll member 20 which will be described later and the annular member constitutes together with said shaft 6 the coupling 6A. To this coupling 6A, a peripheral edge of a driver scroll member 15 is integrally secured by bolts 16. Accordingly, the driver scroll member 15 is rotated integrally with the coupling 6A as the rotor 8 is rotated when the electromotor 12 is energized. The driver scroll member 15 has its scroll 15*a* extending upward.

Said rear side of the driver scroll member 15 is centrally provided with a shaft 17 adapted to be rotatably supported in a step 18 formed integrally with the lower casing 2b by means of a bearing 19.

The follower scroll member 20 is mounted with its scroll 20a extending downward and adapted to be engaged with the scroll 15a of the driver scroll member 15. The rear side of the follower scroll member 20 or the top surface of the follower scroll member 20 as viewed in FIG. 1 is formed with a follower shaft 21 extending upward. The boss 4 is formed with an axial cavity 22 adapted for rotatably supporting said follower shaft 21 having its rotational center $0_2$ which is eccentric with respect to a rotational center $0_1$ by a dimension l.

There is provided between said coupling 6A and the follower scroll member 20 a transmission mechanism 24 serving to transmit rotation of said coupling 6A to the follower scroll member 20. The transmission mechanism 24 comprises an Oldham's coupling consisting of an annular movable plate 25 and guide grooves 28, 29 functioning to guide projections 26, 27 provided on opposite surfaces of said movable plate 25. More specifically, the movable plate 25 is annular and rotatably contained within a recess 30 formed in the coupling 6A, as seen in FIG. 2. The movable plate 25 is provided on one side with a pair of diametrically opposed projections 26 adapted to be inserted into the associated guide grooves 28 formed in the coupling 6A and radially movable with respect to the movable plate. The movable plate 25 is provided on the other side with another pair of diametrically opposed projections 27 which define together a plane perpendicular to that defined by the first-mentioned pair of projections 26 and, as shown in FIG. 1, inserted into the associated guide grooves 29 formed in the follower scroll member 20. These projections 27 are also radially movable with respect to the movable plate. Accordingly, rotation of the coupling 6A causes the driver scroll member 15 to rotate and is transmitted by the transmission mechanism 24 also to the follower scroll member 20. Hereupon, the eccentricity of the follower shaft 21 to the shaft 6 causes an eccentric revolution in the same phase with the driver scroll member 15 (i.e., the follower scroll member 20 completes one revolution while the driver scroll member 15 completes one revolution) so that a suction compression chamber 31, an intermediate compression chamber 32 and a discharge compression chamber 33 are formed between the two scrolls 15a, 20a for successive compression of refrigerant.

The upper casing 2a is provided on its upper side with a suction inlet 35 for refrigerant through which said refrigerant is sucked into the machine, then flows, as indicated by an arrow, between the poles 10a of the electromotor 12, through a passage 36 defined between the coupling 6A and the driver scroll member 15, on one side, and the lower casing 2b, on the other side, into the suction compression chamber 31. The quantity of refrigerant having been successively compressed in the respective chambers 31, 32, 33 is discharged from a discharge port 38 via a discharge passage 39 extending through the follower shaft 21 and the boss 4.

With such scroll type fluid handling machine 1, upon energization of the electromotor 12, the shaft 6 and, therefore, the coupling 6A are rotated, causing the driver scroll member 15 to rotate. Rotation of the coupling 6A is transmitted by the transmission mechanism 24 also to the follower scroll member 20 and, owing to the eccentricity of the follower shaft 21 to the shaft 6, the follower scroll member 20 is eccentrically revolving in the same phase with the shaft 6 so that compression of refrigerant is successively performed in the respective compression chambers 31, 32, 33 defined by the two scrolls 15a, 20a.

The unique arrangement of the invention that the rotor 8 of the electromotor 12 is fixed around the shaft 6 which is, in turn, carried around the boss 4 and the follower shaft 21 is eccentrically supported within the boss 4 enables the axial length of the scroll type fluid handling machine 1 to be significantly reduced to obtain a compact machine.

It should be understood that the rotor of the electromotor may comprise a magnet made of rare earth metal alloy and molded, by the rear side extrusion, integrally with the drive shaft. In such a case, the drive shaft will be solid-phase jointed to the rotor and the radially anisotropic ring-shaped permanent magnet will be provided around the drive shaft so that a stability of the clamped magnet can be substantially improved and therefore a high speed rotation can be accommodated. Said integral molding may be also realized by casting process.

INDUSTRIAL APPLICABILITY

As will be apparent from the foregoing description, the scroll type fluid handling machine of the invention is usefull for the fluid compressor and particularly for a compact full system rotatable scroll type fluid handling machine because it is possible to reduce the axial length of the machine.

What is claimed is:

1. A full system rotatable scroll type fluid handling machine including a sealed casing containing therein an electromotor, a driver scroll member rotatably driven by said electromotor and a follower scroll member adapted to be eccentrically rotated with respect to said driver scroll member so that both the driver scroll member and the follower scroll member are rotated but said follower scroll member presents an eccentric movement while it is rotated, said scroll type fluid handling machine comprising:

a pillar-shaped boss formed on the inner side of said casing, extending in a direction in which a rotational axis of the scroll members extends, and formed with an axial cavity extending from a forward end into the interior thereof;

a coupling having a cylindrical shaft rotatably mounted around said boss;

an electromotor provided with a rotor carried on said shaft of said coupling and a stator located around said rotor;

a follower scroll member having a follower shaft inserted into said cavity of said boss and rotatably supported by said boss;

a rotation transmitting mechanism interposed between said follower scroll member and said coupling to transmit rotation of said coupling to the follower scroll member; and a driver scroll member fixed to said coupling to hold said follower scroll member between said driver scroll member and said coupling.

* * * * *